US007988143B2

(12) United States Patent
Asada et al.

(10) Patent No.: US 7,988,143 B2
(45) Date of Patent: Aug. 2, 2011

(54) SHEET FEEDER

(75) Inventors: Tetsuo Asada, Kuwana (JP); Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 365 days.

(21) Appl. No.: 12/053,452

(22) Filed: Mar. 21, 2008

(65) Prior Publication Data

US 2008/0230979 A1 Sep. 25, 2008

(30) Foreign Application Priority Data

Mar. 23, 2007 (JP) ..... 2007-077213
Mar. 26, 2007 (JP) ..... 2007-079530

(51) Int. Cl.
*B65H 3/52* (2006.01)

(52) U.S. Cl. ..... 271/121; 271/167; 271/124

(58) Field of Classification Search ..... 271/121, 271/167

See application file for complete search history.

(56) References Cited

U.S. PATENT DOCUMENTS

| | | | | |
|---|---|---|---|---|
| 6,139,007 | A * | 10/2000 | Cahill et al. | 271/121 |
| 6,279,897 | B1 * | 8/2001 | Richards | 271/121 |
| 6,874,779 | B2 | 4/2005 | Park | |
| 7,036,814 | B2 * | 5/2006 | Oh et al. | 271/121 |
| 7,066,461 | B2 | 6/2006 | Asada | |
| 7,370,859 | B2 * | 5/2008 | Asada | 271/121 |
| 7,513,495 | B2 * | 4/2009 | Mo | 271/121 |
| 7,852,526 | B2 * | 12/2010 | Mo et al. | 358/498 |
| 2005/0194734 | A1 | 9/2005 | Asada et al. | |
| 2006/0180992 | A1 | 8/2006 | Asada | |

FOREIGN PATENT DOCUMENTS

| | | | |
|---|---|---|---|
| JP | 2002-068503 | A | 3/2002 |
| JP | 2003-192204 | A | 7/2003 |
| JP | 2004-067389 | A | 3/2004 |
| JP | 2005-247550 | A | 9/2005 |
| JP | 3757928 | B2 | 1/2006 |
| JP | 2006-103817 | A | 4/2006 |
| JP | 2006-182481 | A | 7/2006 |

* cited by examiner

*Primary Examiner* — Stefanos Karmis
*Assistant Examiner* — Luis A Gonzalez
(74) *Attorney, Agent, or Firm* — Baker Botts L.L.P.

(57) ABSTRACT

A sheet feeder comprising: a cassette; a feed roller; a sloping separation plate provided on a downstream side of the cassette in a sheet feeding direction; and a separation member that includes a first separation claw and second separation claw, the first separation claw being closer a bottom surface of the cassette than the second separation claw, the separation member and the feed roller cooperating with each other to separate and feed the sheets, sheet by sheet; wherein the sloping separation plate has openings so as to allow distal projecting portions of the first separation claw and second separation claw to project through the sloping separation plate, respectively, and wherein, a first angle formed between the distal projecting portion of the first separation claw and the sloping separation plate is larger than a second angle formed between the distal projecting portion of the second separation claw and the sloping separation plate.

13 Claims, 14 Drawing Sheets

SHEET FEEDER

CROSS REFERENCE TO RELATED APPLICATION

The present application claims priorities from Japanese Patent Application No. 2007-077213, which was filed on Mar. 23, 2007, and Japanese Patent Application No. 2007-079530, which was filed on Mar. 26, 2007, the disclosures of which are herein incorporated by reference in its entirety.

TECHNICAL FIELD

The present invention relates to a sheet feeder for separating recording media (sheets) stacked in a sheet feeding cassette main body. In the present invention, the sheet feeder feeds sheets into an image recording unit sheet by sheet by a feed roller and a plurality of elastic separation claws.

BACKGROUND

An image forming apparatus such as a printer, a copying machine, a facsimile or the like has a sheet feeder for separating sheets (recording media) to feed them to an image recording unit thereof sheet by sheet.

Publication of Japanese Unexamined Patent Application No. 2005-247550 (refer to FIGS. 3 to 9. Hereinafter, Patent Document 1) disclosed a sheet feeder that includes a sheet feeding cassette in which a plurality of sheets are stacked and a feed roller provided at a lower end of a feed arm that is disposed above the sheet feeding cassette in such a manner as to oscillate vertically. In addition, a sloping separation plate is provided at a down stream end portion of the sheet feeding cassette in a sheet feeding direction, and a sheet separation member is provided in a central portion of the sloping separation plate in a lateral direction thereof (a sheet width direction). This sheet separation member is such that claw-like projecting portions, arm portions which support the projecting portions from both sides thereof and leaf spring portions are formed on a base portion made of a metal sheet at predetermined intervals through press work, and the leaf spring portions are formed integrally with the base portion to support the sheet separation member on a rear surface of the sloping separation plate. The claw-like projecting portions are set to project a predetermined amount from elongated openings which are opened in a central portion of the sloping sheet separation plate along the sheet feeding direction. Thus, the feed roller, that is rotating, feeds a topmost sheet while pressing against an upper surface of the topmost sheet. As this occurs, leading edges of the sheets so stacked are brought into engagement with the projecting portions, whereby the stacked sheets are loosened so that only the topmost sheet is separated to be fed.

Publication of Japanese Unexamined Patent Application No. 2004-067389 (refer to FIGS. 4 to 6. Hereinafter, Patent Document 2) disclosed a sheet feeder that includes a sheet feeding cassette main body that is opened in an upper surface thereof to accommodate sheets in a substantially horizontal state. A sloping surface is provided at a downstream end of the sheet feeding cassette main body in a sheet feeding direction, and a sheet separation guide is provided on the sloping surface. A plurality of projections are formed on the surface of the sheet separation guide. The projections are highest at a lowest portion of the sheet separation guide, and the projections decrease gradually their height at predetermined intervals towards an upper end of the sheet separation guide. In this way, the friction coefficient of the projections with the end portions of the sheets is set to gradually decrease from the lower projections towards the upper ones. In addition, the projections are formed in a plurality of rows in a sheet width direction.

SUMMARY

In a sheet feeder comprising a feed roller that is provided at a lower end of a feed arm that has a predetermined length and the feed roller that is a pendulum type feed roller adapted to oscillate vertically about a proximal end of the feed arm, a sheet feeding operation is implemented as will be described below. That is, the feed roller rotates while pressing against a topmost sheet stacked in the sheet feeding cassette to thereby separate only the topmost sheet from the rest of the sheets to feed the sheet in cooperation with the projections. As this occurs, a conveying force applied by the feed roller, that is, a picking force (a force in a direction parallel to the surface of the sheet) becomes a value which results by subtracting a frictional force between the topmost sheet and a sheet lying beneath the topmost sheet from a value obtained by multiplying a pressure exerted on to the topmost sheet by the feed roller (a force applied in a direction vertical to the surface of the sheet) by a friction coefficient relative to the topmost sheet. In addition, the pressure becomes larger as an angle formed between the arm and the topmost sheet increases. In other words, the pressure becomes small when a large pile of sheets is stacked (or when the height of stacked sheets is high), whereas the pressure becomes large when a small pile of sheets is stacked (or when the height of stacked sheets is low). The frictional force between the topmost sheet and the sheet lying underneath the topmost sheet varies little even though the height of stacked sheets varies.

Accordingly, the conveying force by the feed roller, that is, the picking force becomes small when the large pile of sheets is stacked (or when the height of stacked sheets is high), whereas the picking force becomes large when the small pile of sheets is stacked (or when the height of stacked sheets is low). On the other hand, in the event that the conveying force by the feed roller becomes too large compared to the resisting force produced as a result of the separating action by the projections on the surface of the sloping separation plate (the sheet separation guide), a so-called double- or more-sheet feeding phenomenon is produced in which a plurality of sheets is fed at one time. This phenomenon tends to be easily produced when a small pile of sheet is stacked (or when the height of stacked sheets is low). On the contrary, in the event that the resisting force produced as a result of the separating action of by the projections becomes too large compared with the conveying force by the feed roller, the sheet cannot be conveyed (a so-called idle feeding state is produced).

However, in the configuration described in Patent Document No. 1, only the single row of claw-like projections was provided on the surface of the sloping sheet separation plate in such a manner as to project therefrom, and no consideration was taken for the projecting amount of the projections so provided.

On the other hand, in Patent Document No. 2, it is proposed that the projecting height of the projections gradually decreases at predetermined intervals as they approach the upper portion of the sheet separation guide so that the friction coefficient gradually decreases from the bottom to the top of the sheet separation guide (that is, the resisting force produced as a result of the separating action by the projections is made to decrease gradually as they approach the upper portion of the sheet separation guide).

However, in Patent Document No. 2, the plurality of projections are formed integrally on the surface of the sheet separation guide which is made of a flat sheet (whose material is unknown), and since no elasticity is imparted to the projections, there has been caused a problem that the projections get worn heavily after use over a long period of time and hence the sheet separation performance cannot be held over a long period of time.

The invention has been made to solve the problem, and an object thereof is to provided a sheet feeder which ensures the feeding of a recording medium to the image recording unit and which prevents idle feeding.

BRIEF DESCRIPTION OF THE DRAWINGS

Illustrative aspects of the invention will be described in detail with reference to the following figures wherein.

DETAILED DESCRIPTION OF THE PREFERRED EMBODIMENTS

Figure 1:
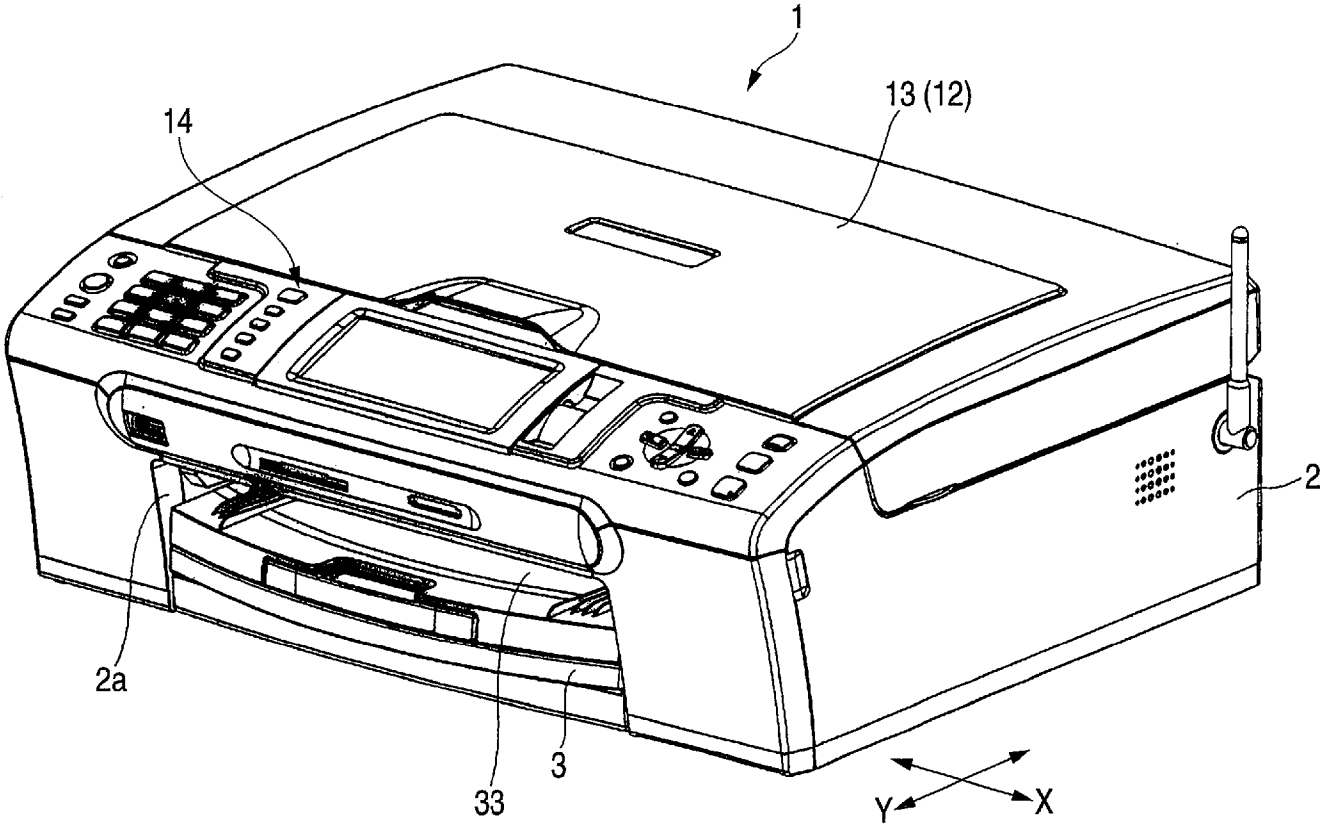
FIG. 1 is a perspective view of an image forming apparatus according to the exemplary embodiment.
Figure 2:
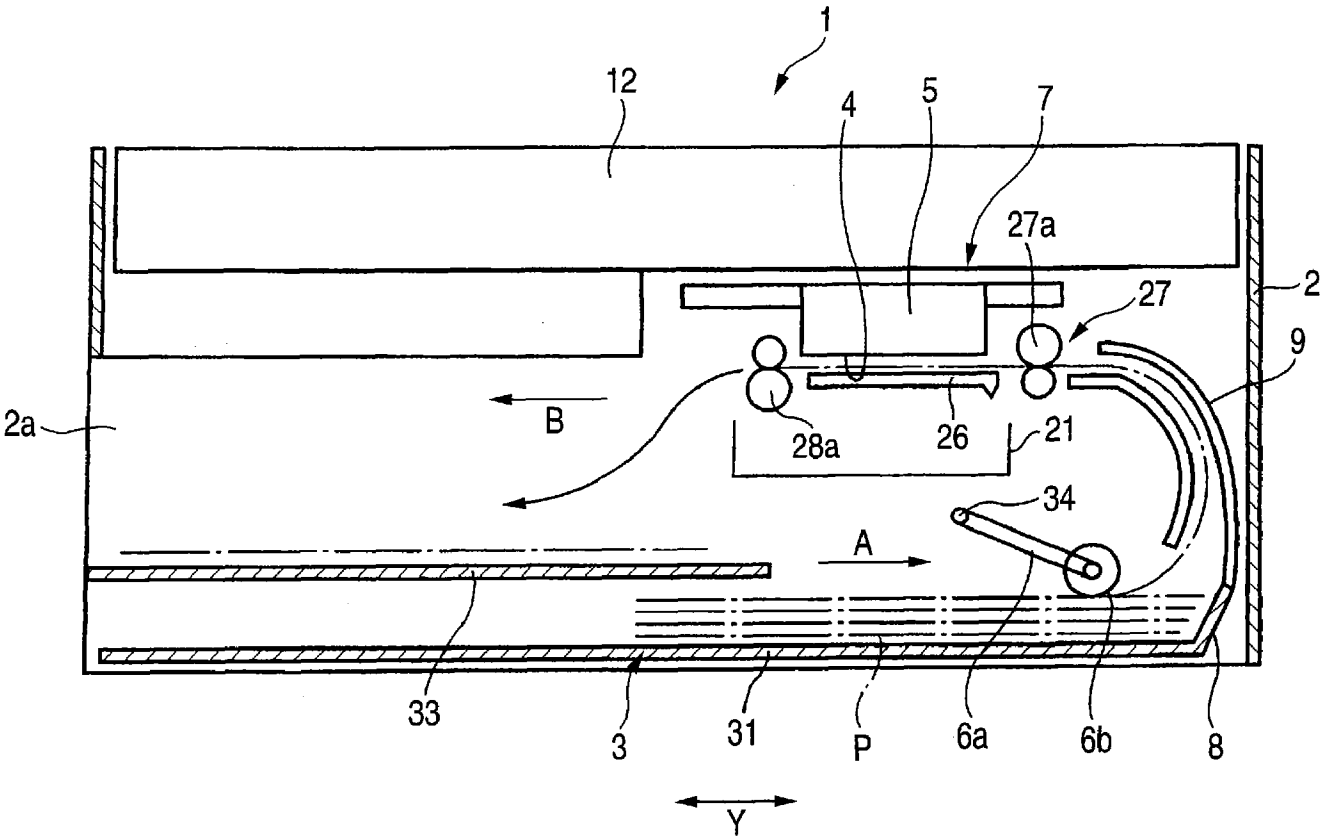
FIG. 2 is a schematic sectioned side view of the image forming apparatus according to the exemplary embodiment.
Figure 3:
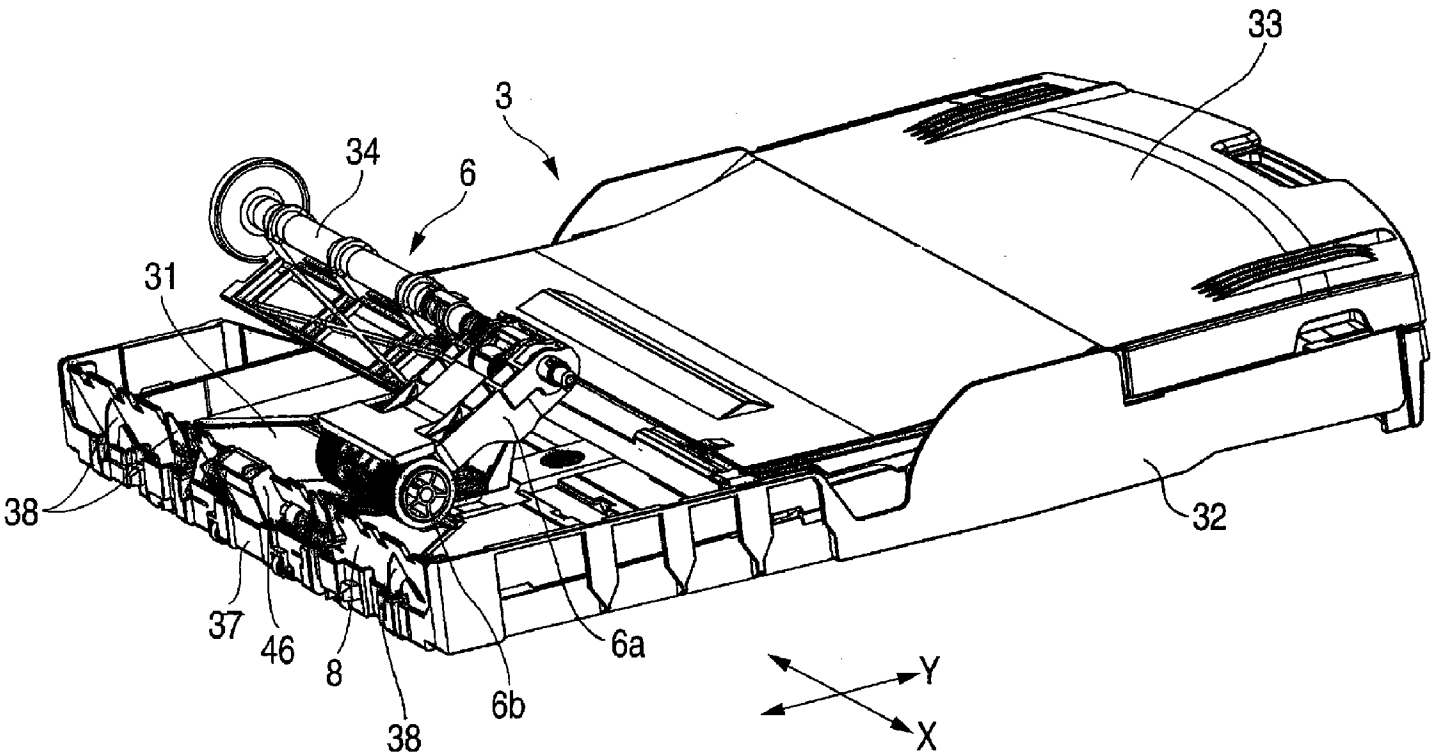
FIG. 3 is a perspective view of a cassette main body and a feed roller.
Figure 4:
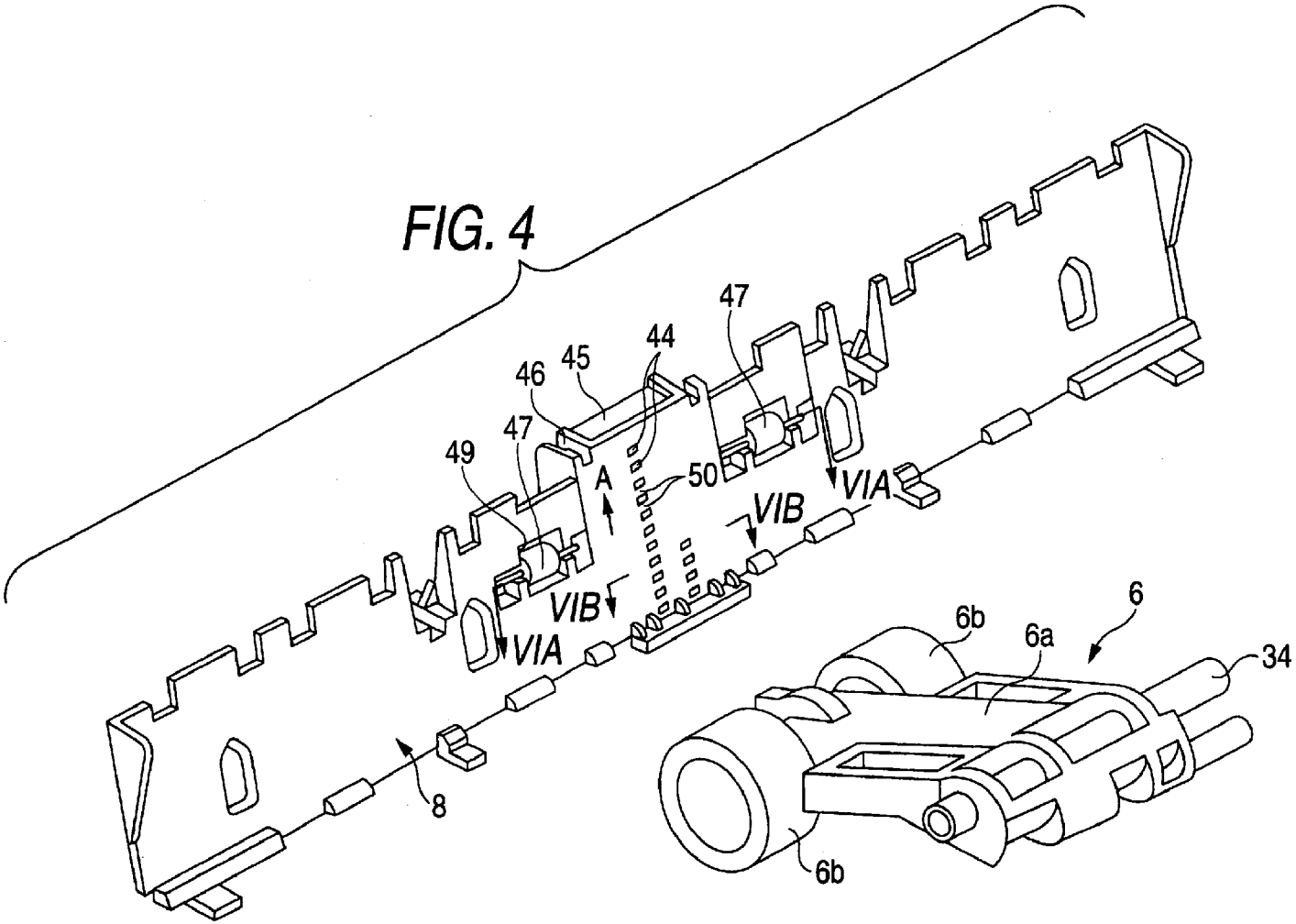
FIG. 4 is a perspective view of a sloping separation plate and the feed roller.
Figure 5:
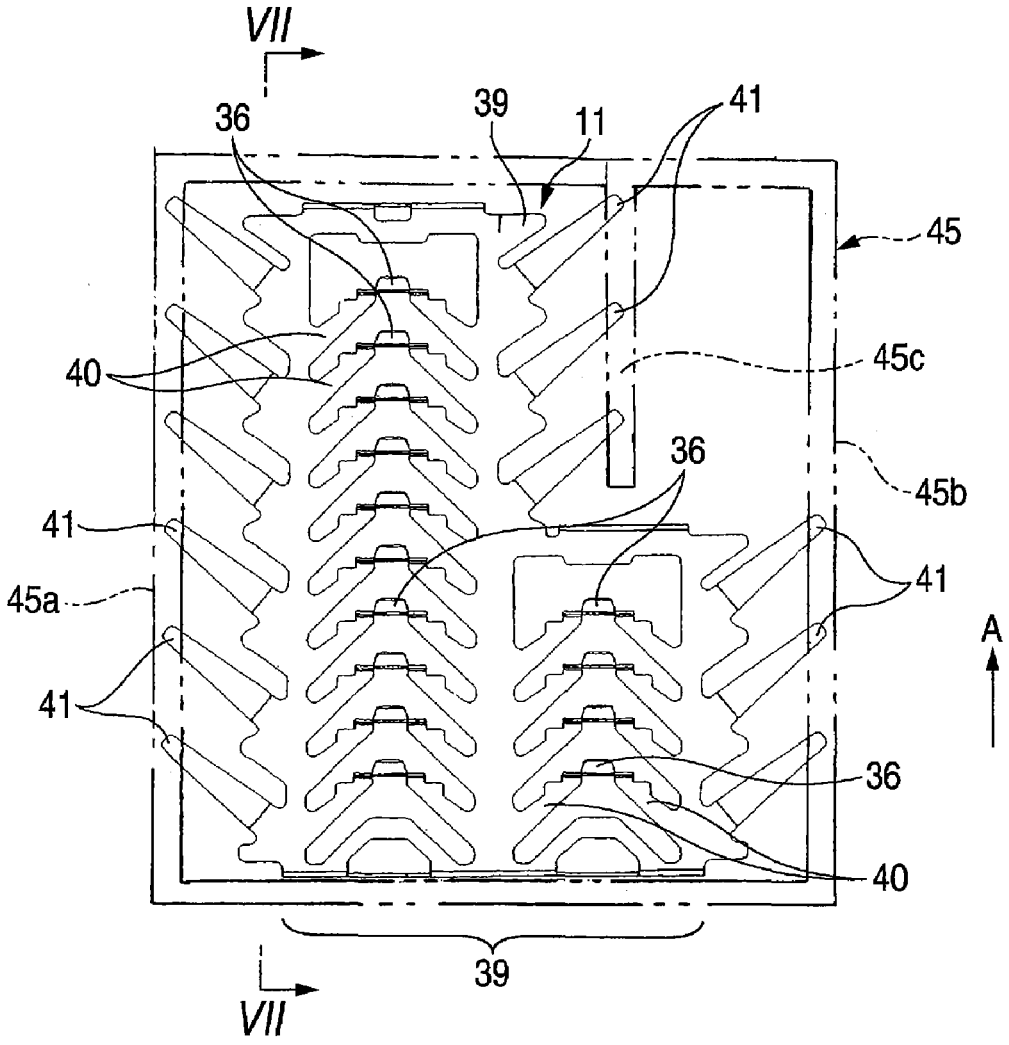
FIG. 5 is a front view of a separation module according to the first exemplary embodiment.
Figure 6A:
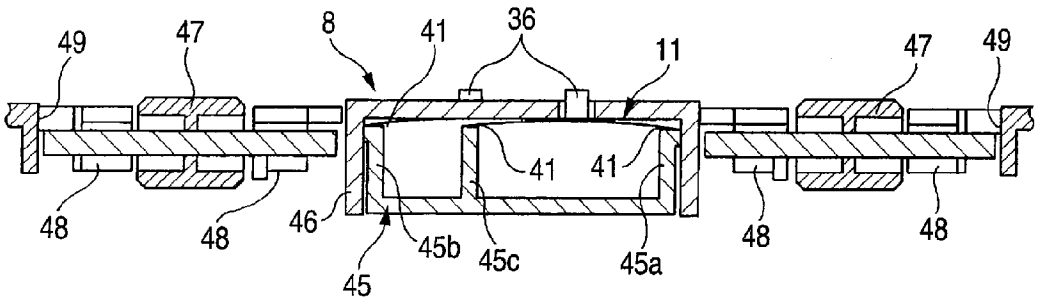
FIG. 6A is a sectional view taken along the line VIA-VIA of FIG. 4 and viewed in a direction indicated by arrows attached to the line.
Figure 6B:
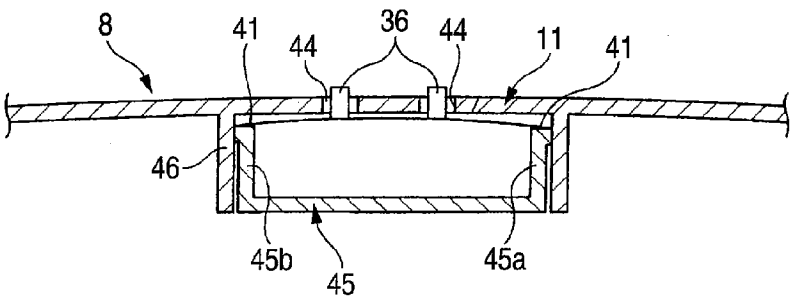
FIG. 6B is a sectional view taken along the line VIB-VIB of FIG. 4 and viewed in a direction indicated by arrows attached to the line.
Figure 7:
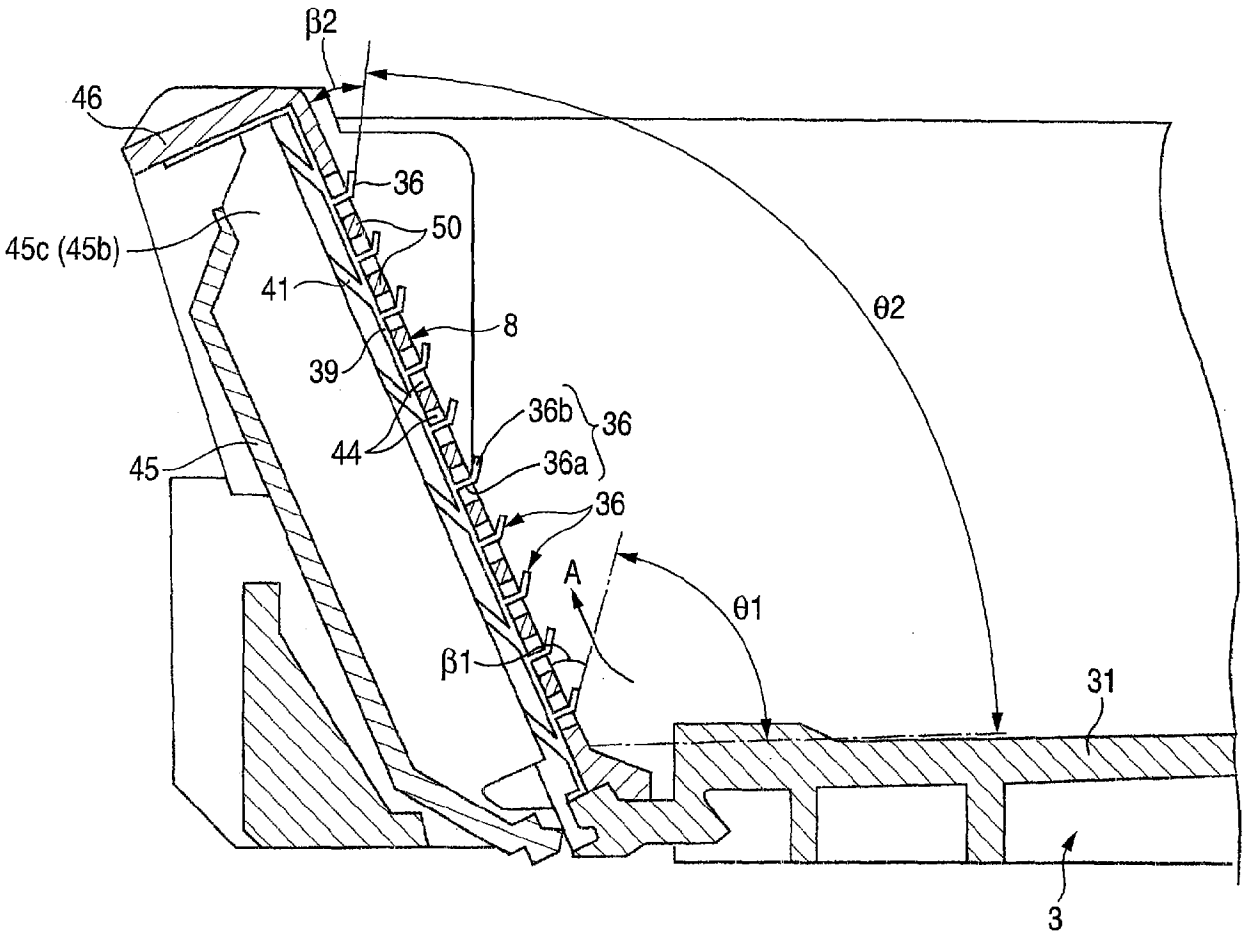
FIG. 7 is an enlarged sectional view taken along the line VII-VII of FIG. 5 and viewed in a direction indicated by arrows attached to the line.
Figure 8:
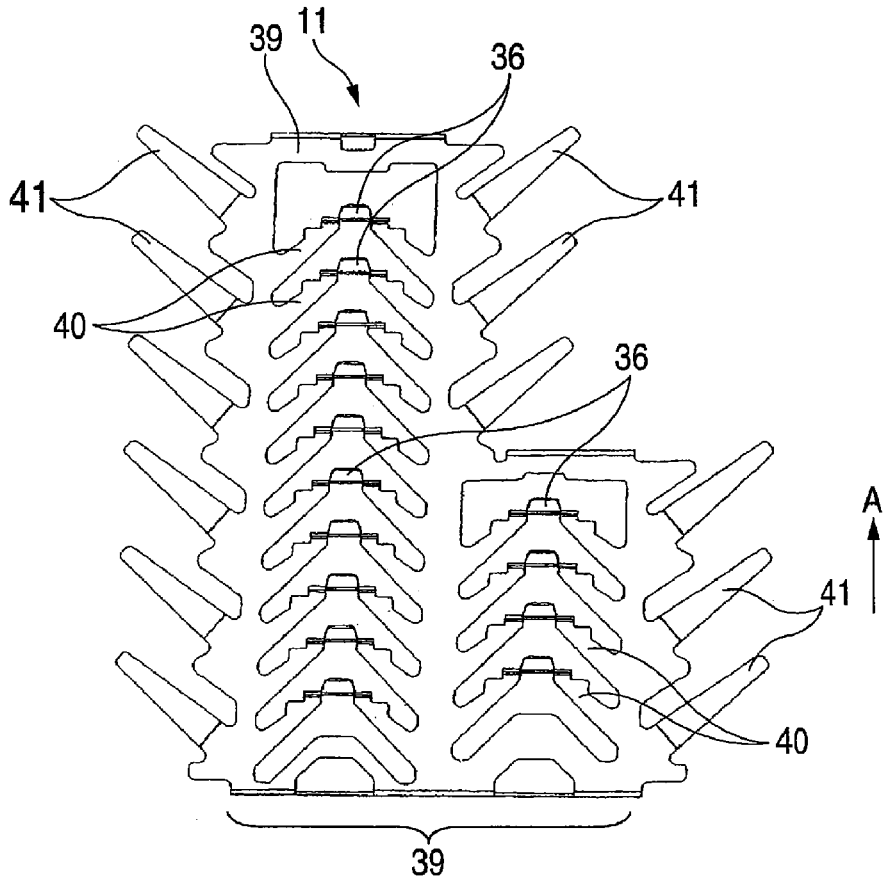
FIG. 8 is a front view of a separation module according to the second exemplary embodiment.
Figure 9:
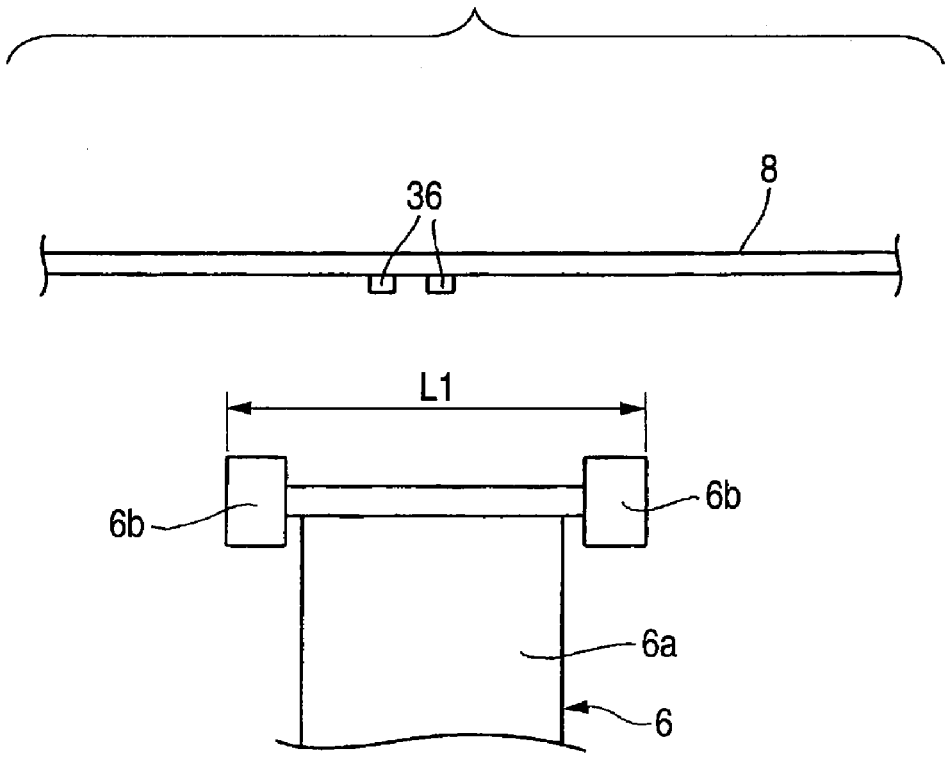
FIG. 9 is an explanatory view that illustrates a positional relationship between the separation module and feed rollers according to the first exemplary embodiment and the second exemplary embodiment.
Figure 10:
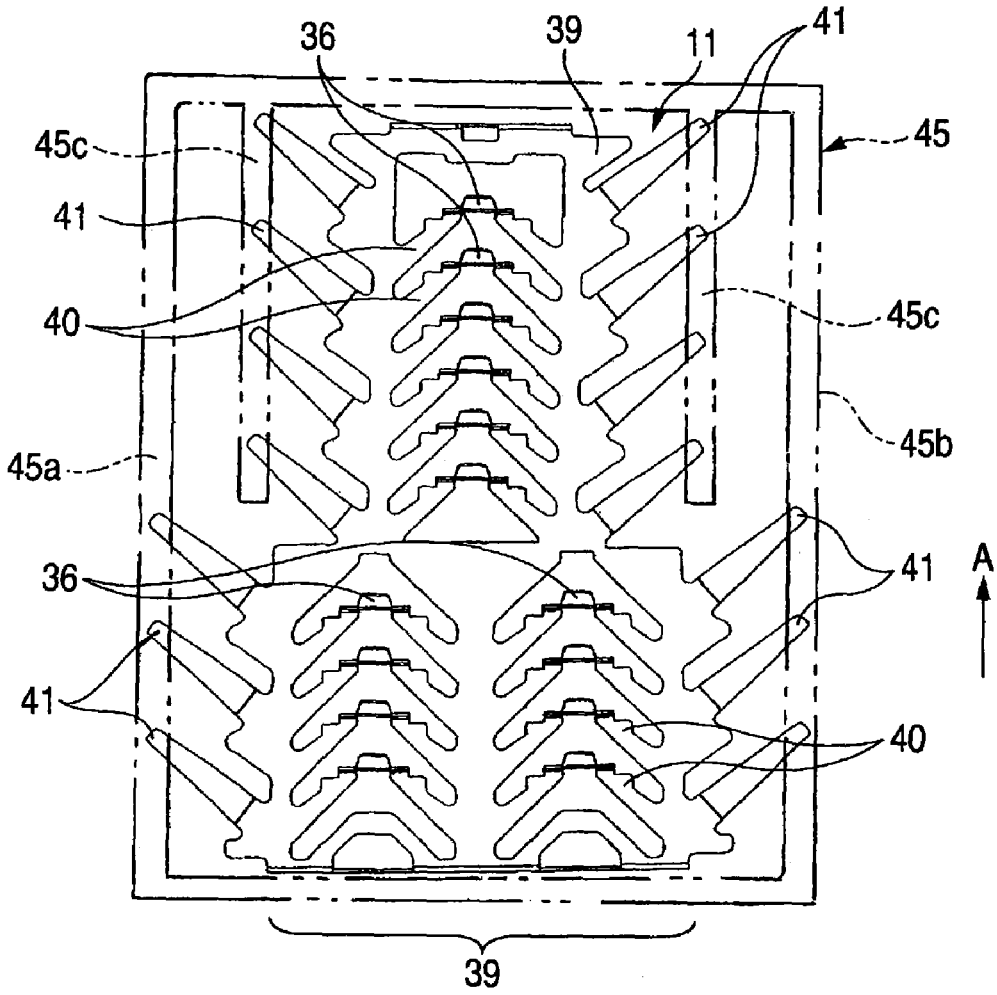
FIG. 10 is a front view of a separation module according to the third exemplary embodiment.
Figure 11:
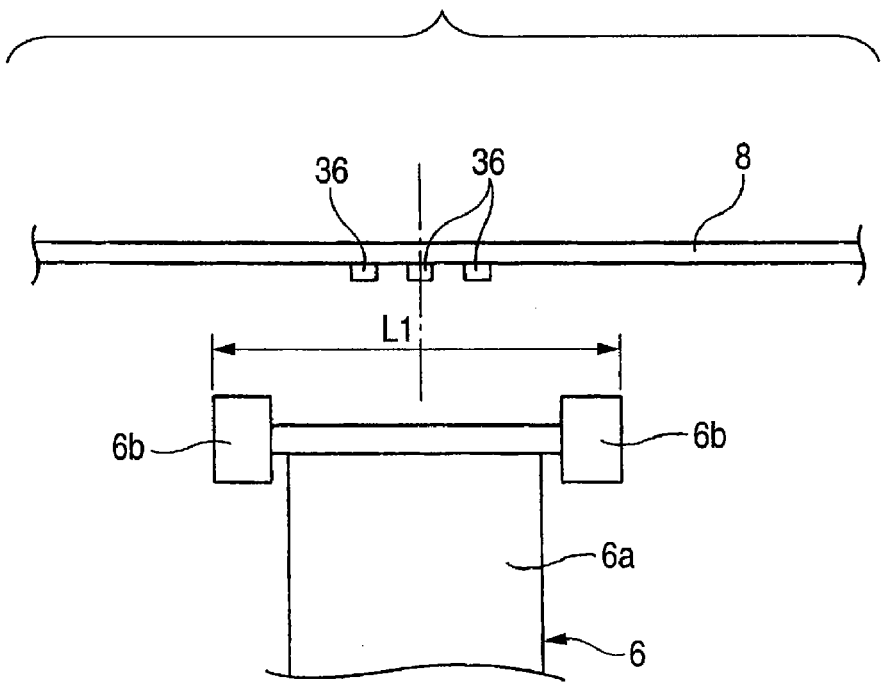
FIG. 11 is an explanatory view that illustrates a positional relationship between the separation module and feed rollers according to the third embodiment.

Hereinafter, exemplary embodiments of the present invention will be described based on the drawings. FIG. 1 is a perspective view of an image forming apparatus that includes an ink jet recording head, FIG. 2 is a schematic sectioned side view, FIG. 3 is a perspective view of a cassette main body and a feed roller, FIG. 4 is a perspective view of a sloping separation plate and the feed roller, FIG. 5 is a front view of separation claws according to the first exemplary embodiment, FIG. 6A is a sectional view taken along the line VIA-VIA of FIG. 4 and viewed in a direction indicated by arrows attached to the line, FIG. 6B is a sectional view taken along the line VIB-VIB of FIG. 4 and viewed in a direction indicated by arrows attached to the line, FIG. 7 is an enlarged sectional view taken along the line VII-VII of FIG. 5 and viewed in a direction indicated by arrows attached to the line, FIG. 8 is a front view of separation claws according to the second exemplary embodiment, FIG. 9 is an explanatory view which illustrates a positional relationship between the separation claws and feed rollers of the first and second exemplary embodiments, FIG. 10 is a front view of separation claws according to the third exemplary embodiment, and FIG. 11 is an explanatory view which illustrates a positional relationship between the separation claws and feed rollers of the third exemplary embodiment.

An image forming apparatus 1 of a first exemplary embodiment of the present invention is applied to a multi function device (MFD) that comprises a printer function, a copier function, a scanner function and a facsimile function. As shown in FIG. 1 and FIG. 2, this image forming apparatus 1 includes a housing 2 that is made up of an injection molded article of a synthetic resin.

An image reading device 12 is disposed in an upper portion of the housing 2 for use in the copier function and the facsimile function. This image reading device 12 is made to rotate vertically to be opened or closed at one side edge of the housing 2 via a pivot (not shown). Furthermore, a document cover unit 13 that covers an upper surface of the image reading device 12 is mounted at a rear edge of the image reading device 12 in such a manner as to rotate about a pivot (not shown) to be opened or closed at a rear edge thereof.

A control panel unit 14, which includes various control buttons and a liquid crystal display module, is provided in front of the image reading device 12 on an upper side of the housing 2. In addition, a document placing platen glass (not shown) is provided on the upper surface of the image reading device 12, so that an original document can be placed thereon by opening the document cover unit 13 upwards. And a contact image sensor (CIS) (not shown) for reading or sensing an original document is provided underneath the platen glass in such a manner as to reciprocate along a guide shaft that extends in a direction (an X-axis direction as viewed in FIG. 1) perpendicular to the sheet drawn in FIG. 2.

In the first exemplary embodiment, ink cartridges of individual colors, that is, four ink cartridges of black (B), cyan (C), magenta (M) and yellow (Y) are accommodated in an ink storage unit (not shown). In addition, a recording head 4 in a recording unit 7 is connected individually to the ink cartridges by flexible ink supply tubes at all times. By this configuration, inks of the individual colors are supplied from the respective ink cartridges to the recording head 4.

A cassette main body 3 is disposed in a lower portion (a bottom portion) of the housing 2. The cassette main body 3 is inserted into or removed from the housing 2 via an opening 2*a* formed at a front side (a left-hand side as viewed in FIG. 2) of the housing 2. In the first exemplary embodiment, the cassette main body 3 is a form in which sheets P cut to an A4 size, letter size, legal size, a post card size or the like can be stored as recording media (cut sheets) therein in a pile of sheets (stacked one on the top of another). In the cassette main body 3, a shorter side of the sheet extends in a direction (in the direction perpendicular to the sheet drawn in FIG. 2) perpendicular to a sheet conveying direction (a Y-axis direction).

As shown in FIG. 3, a bottom plate 31, on which the sheets P are placed, is provided in the cassette main body 3 of a sheet feeder. And side plates 32, 32 are provided on both side of the bottom plate 31 which extend along a sheet feeding direction (a direction indicated by an arrow A in FIG. 2) in such a manner as to erect therefrom. In addition, in the first exemplary embodiment, a sheet discharging tray 33 is mounted on part of the side plates 32, 32 in such a manner as to extend there between so as to cover a part of an upstream side of the sheets P placed on the bottom plate 31 in the sheet feeding direction (the direction indicated by the arrow A). In addition, the sheet discharging tray 33 is mounted on the cassette main body 3 in such a manner as to rotate to be opened or closed about a rotational shaft (not shown) so that it is easy to accommodate sheets P on the bottom plate 31 of the cassette main body 3.

In addition, sheet width guides (not shown), which not only set sheets P laterally symmetrically relative to a center of the cassette main body 3 in a width direction of the sheets P but also guide the sheets P along the conveying direction of the sheets P, are disposed on a downstream side of the bottom plate 31 in the sheet feeding direction (the direction indicated by the arrow A). And, the sheet width guides can move in a transverse direction (the width direction of the sheet P: the X-axis direction) while being made to link with each other.

A sloping separation plate 8, which includes a separation module 11 for separating the sheets P sheet by sheet at leading edges thereof, is detachably fixed to a far side (a right-hand side in FIG. 2, and a left-hand side in FIG. 3) of the cassette main body 3. In addition, as will be described later, a proximal end portion of a feed arm 6*a* of a feed roller 6 is mounted in such a manner as to rotate vertically about a drive shaft 34. A drive force from a driving source (not shown) is transmitted to a pair of left and right feed rollers 6*b* which are provided at a distal end portion of the feed arm 6*a* via the drive shaft 34 and a gearwheel transmission mechanism which is provided in an interior of the feed arm 6*a* (refer to FIGS. 3, 4).

As described above, the feed roller 6 includes the feed arm 6*a*, the pair of feed rollers 6*b* and the drive shaft 34. In addition, the pair of left and right feed rollers 6*b*, in which a member such as a rubber having a high friction coefficient is wound round outer circumferential portions of the feed rollers 6*b*, are rotatably supported on both left- and right-hand sides of a free end portion (the lower end) of the feed arm 6*a* that is formed of a synthetic resin into a frame shape. In addition, the proximal end portion of the feed arm 6*a* is rotatably supported at a distal end portion of the drive shaft 34 that is made of a synthetic resin. Then, the drive force transmitted to the drive shaft 34 from the driving source (not shown) is transmitted to the feed rollers 6*b* via the gearwheel transmission mechanism that includes gearwheels. As a result, the feed rollers 6*b* rotate in a predetermined direction (a direction in which the sheets P stored in the cassette main body 3 are conveyed). In addition, the gearwheel transmission mechanism comprises: a gearwheel that rotates together with the drive shaft 34; a planetary gear that meshes with the gearwheel and is pivotally supported on a distal end of a planetary arm which is rotatably fitted on the drive shaft 34; and a plurality of intermediate gearwheels for transmitting power from the planetary gearwheel to gearwheels disposed on side portions of the feed rollers 6*b*.

Then, the sheets P, which are recording media stacked in the cassette main body 3, are separated and fed sheet by sheet from a topmost of sheets P by cooperation with the feed roller 6*b* and the separation module 11 provided in the sloping separation plate 8. The separated sheet P is conveyed to the recording unit 7 provided above the cassette main body 3 (at a higher position) via a conveyance path 9 that includes a U-turn path as viewed in a horizontal direction. The conveyance path 9 is defined by a gap formed between a first conveyance path member that makes up an outer circumferential side of the U-turn shape and a second conveyance path member that is a guide member making up an inner circumferential side thereof. In the conveyance path 9, the sheet P is conveyed in a state in which a center line of the sheet P in the width direction is aligned with a center line (not shown) of the conveyance path 9 in a width direction perpendicular to the sheet feeding direction (herein after, simply referred to as a width direction).

The recording unit 7 is fixedly supported by a box-type main frame 21 and a pair of left and right side plates thereof. And, the recording unit 7 is disposed between a first guide member and a second guide member. The first guide member and the second guide member have a transversely elongated plate-shape that extends in the X-axis direction (a main traveling direction of the recording head 4). A carriage 5, which includes the ink jet recording head 4 of the recording unit 7, is slidably supported (mounted) in such a manner as to extend between the first guide member that is disposed on an upstream side and the second guide member that is disposed on a downstream side of the sheet feeding direction. And, the carriage 5 can reciprocate along the first guide member and the second guide member in the main traveling direction (the X-axis direction).

A timing belt (not shown) is disposed on an upper surface of the second guide member that is disposed on the downstream side of the sheet feeding direction (the direction indicated by the arrow A) in such a manner as to extend in the main traveling direction (the X-axis direction) so as to allow the carriage 5 to reciprocate. And a CR (carriage) motor (not shown) for driving the timing belt is fixed to a lower surface of the second guide member.

A flat-shaped platen 26, which extends in the X-axis direction in such a manner as to be opposite to a lower surface of the recording head 4 of the carriage 5, is fixed to the main frame 21 between the first guide member and the second guide member.

A drive roller 27*a* and a driven roller that is provided underneath the drive roller 27*a* to face the roller 27*a* are disposed at an upstream side of the platen 26 in the conveying direction. The drive roller 27*a* and the driven roller are provided as a conveying (registration) roller for conveying the sheet P into a position underneath the lower surface of the recording head 4. In addition, a discharge roller 28*a* and a spur roller are disposed at a downstream side of the platen 26 in the conveying direction (refer to FIG. 2). The discharge roller 28*a* is driven to convey (discharge) the printed sheet P into the sheet discharging tray 33, and the spur roller is made to face the discharge roller 28*a* and is biased thereto.

Next, the configurations of the sloping separation plate 8 and the separation module 11 will be described. As shown in FIGS. 3 to 7, the sloping separation plate 8 for separating sheets is detachably disposed at a far side end portion (a left-hand side end) of the cassette main body 3. And the sloping separation plate 8 and the cassette main body 3 are injection molded articles of a synthetic resin. The sloping separation plate 8 is formed into the shape of a single continuous plate. The sloping separation plate 8 is formed into a convexly curved shape as viewed from the top. As viewed from the top of the sloping separation plate 8, the sloping separation plate 8 projects in a central portion thereof in the width direction (the X-axis direction) of the sheet P, and the sloping separation plate recedes as it extends from the central portion towards left and right end portions thereof in the width direction of the sheet P. Furthermore, a separation module 11, on which separation claws (claw-shaped elastic elements) 36 are formed integrally in such a manner as to be brought into abutment with leading edges of sheets P to promote the separation of the sheets from each other, is configured to be mounted in the central position of the sloping separation plate 8 from a back side thereof.

A plurality of back supporting portions 38, which are each formed into a triangular shape as viewed from the side thereof, are provided on a back side of the sloping separation plate 8 at predetermined intervals along the X-axis direction. The back supporting portions 38 are disposed so as to be brought into abutment with a far side plate 37 of the cassette main body 3 when the sloping separation plate 8 is mounted on the cassette main body 3. Accordingly, as described above, the sloping separation plate 8 is maintained in the convexly curved shape as viewed from the top and is prevented from being deformed when the sheet P is conveyed.

Furthermore, a plurality of openings 44 are provided in a central portion of the sloping separation plate 8 as viewed in a longitudinal direction thereof (the X-axis direction, the width direction of the sheet P). And, the openings 44 are provided along the feeding direction (the direction indicated by the arrow A, refer to FIGS. 4, 5, 7 and the like), the separation claws 36 of the separation module 11 pass through the openings 44 to the sheet contact side of the sloping separation plate from the back side thereof. These openings 44 are opened in two rows and at predetermined intervals (intervals equal to those at which the separation claws 36 are disposed) (refer to FIGS. 4, 7). The separation claws 36 are allowed to project to the sheet contact side (the front surface) of the sloping separation plate 8 from these openings 44. Accordingly, portions (bridge portions) 50 between the adjacent small openings 44 are integral with the sloping separation plate 8. In addition, a mounting case 46 for supporting the separation module 11 is formed integrally on the back side of the sloping separation plate 8 in such a manner as to surround all the openings 44. The mounting case 46 can accommodate a box-shaped supporting member 45 (a supporting unit) made of a synthetic resin, which will be described later. The separation module 11 is fixedly supported by the mounting case 46 and the supporting member 45 (refer to FIGS. 6A and 6B).

Each separation claw 36 has a proximal portion 36*a* that erects at right angles from the arm portion 40 and a distal end projecting portion (also referred to as a free end side) 36*b* that is bent from the proximal portion 36*a* in such a manner as to fall to be inclined towards the downstream side in the sheet feeding direction (inclined obliquely upwards relative to the sheet contact (front) surface of the sloping separation plate 8) (refer to FIG. 7). In addition, as shown in FIG. 7, it is assumed that an angle, which is an acute angle side, formed between the distal end projecting portion 36*b* that is disposed on the upstream side of the feeding direction and the sheet contact surface of the sloping separation plate 8 is β1 (contained angle). The upstream side is closer to the bottom plate 31 of the cassette main body 3, and the distal end projection portion 36*b*, which is disposed on the up stream side of the feeding direction, makes contact with the sheet P in a state in which a small pile of sheets P is stacked. Furthermore, it is assumed that an angle, which is an acute angle side, formed between the distal end projecting portion 36*b* that is disposed on the downstream side of the feeding direction and the sheet contact surface of the sloping separation plate 8 is β2 (contained angle). The downstream side is father to the bottom plate 31 of the cassette main body 3, and the distal end projection portion 36*b*, which is disposed on the downstream side of the feeding direction, makes contact with the sheet P in a state in which a large pile of sheets P is stacked. In the first exemplary embodiment, the angle β1 is set larger than the angle β2. In the first exemplary embodiment, the angle β2 is about 30 degrees, and the angle β1 is about 40 degrees. Consequently, in FIG. 7, an angle θ1 formed between an upper surface of the bottom plate 31 and the distal end projecting portion 36*b*, which is corresponding to the angle β1, is about 70 degrees, and an angle θ2 formed between the upper surface of the bottom plate 31 and the distal end projecting portion 36*b*, which is corresponding to the angle β2, is about 80 degrees.

In this way, the feed resisting force, which is formed by the separation claws 36 and the feed rollers 6*b*, can be increased on the upstream side of the feeding direction by making the angle β1 larger than the angle β2. That is, when a small pile of the sheets P is stacked in the cassette main body 3, the feed resisting force, which is formed by the separation claws 36 and the feed rollers 6*b* which are mounted at the lower end of the feed arm 6*a* which is made to oscillate about the proximal end (upper end) thereof, can be increased. Because of this, the loosening operation of the leading end portions of the plurality of sheets P can be ensured even in such a state that a small pile of sheets P is stacked in the cassette main body 3, thereby making it possible to reduce the occurrence of double- or more-sheet P feeding phenomenon.

On the other hand, the feed resisting force, which is formed by the separation claws 36 and the feed rollers 6*b*, does not become too large on the downstream side of the feeding direction by making the angle β2 smaller than the angle β1. That is, when a large pile of the sheets P is stacked in the cassette main body 3, the feed resisting force, which is formed by the separation claws 36 and the feed rollers 6*b* which are mounted at the lower end of the feed arm 6*a* which is made to oscillate about the proximal end (upper end) thereof, does not become too large, thereby making it possible to reduce the occurrence of sheet P idle feeding.

In positions lying further outwards in the width direction of the sheet P than the mounting case 46, bearing units 48 for a pair of freely rotating rollers 47 are provided on the back side of the sloping separation plate 8 in order to realize a smooth feeding operation of sheets P (refer to FIGS. 4 and 6A).

In the first exemplary embodiment, a larger number of rows of separation claws 36 are disposed on the upstream side of the feeding direction (the side closer to the bottom plate 31 of the cassette main body 3, and hence corresponding to the state in which the small pile of sheets P is stacked in the cassette main body 3), and a small number of rows of separation claws 36 are disposed on the downstream side of the feeding direction (the side farther from the bottom plate 31 of the cassette main body, and hence corresponding to the state in which the large pile of sheets P is stacked in the cassette main body 3). In short, a larger number of rows of separation claws 36 are disposed on the upstream side of the feeding direction than on the downstream side of the feeding direction.

In the first exemplary embodiment (refer to FIG. 5), the second exemplary embodiment (refer to FIG. 8) and the third exemplary embodiment (refer to FIG. 10), the number of rows of separation claws 36 is two on the upstream side of the feeding direction and is one on the downstream side of the feeding direction. However, the number of rows of separation claws 36 is not limited thereto, and hence, any numbers can be adopted provided that a large number of rows of separation claws 36 are disposed on the upstream side of the feeding direction than on the downstream side of the feeding direction.

The feed resisting force, which is formed by the separation claws 36 and the feed rollers 6*b*, can be increased on the upstream side of the feeding direction by increasing the number of rows of separation claws 36 on the upstream side of the feeding direction. That is, when a small pile of the sheets P is stacked in the cassette main body 3, the feed resisting force, which is formed by the separation claws 36 and the feed rollers 6*b* which are mounted at the lower end of the feed arm 6*a* which is made to oscillate about the proximal end (upper end) thereof, can be increased. Because of this, the loosening operation of the leading end portions of the plurality of sheets P can be ensured even in such a state that a small pile of sheets P is stacked in the cassette main body 3, thereby making it possible to reduce the occurrence of double- or more-sheet P feeding phenomenon. On the other hand, the feed resisting force, which is formed by the separation claws 36 and the feed rollers 6*b*, does not become too large on the downstream side of the feeding direction by reducing the number of rows of separation claws 36 on the downstream side of the feeding direction. That is, when a large pile of the sheets P is stacked in the cassette main body 3, the feed resisting force, which is formed by the separation claws 36 and the feed rollers 6*b* which are mounted at the lower end of the feed arm 6*a* which is made to oscillate about the proximal end (upper end) thereof, does not become too large, thereby making it possible to reduce the occurrence of sheet P idle feeding.

The separation claws 36 are formed on a single or a plurality of separation modules 11, and the separation modules 11 are detachably provided on the back side of the sloping separation plate 8. As described above, the separation module 11 is accommodated in the back-open type mounting case 46. In addition, the separation module 11 is fixedly supported by mounting the detachable box-shaped supporting member 45 from the back side of the mounting case 46, in such a manner as not to be dislocated therefrom (refer to FIGS. 6A and 6B). In the case of a plurality of separation modules 11 being provided, mounting cases 46 are formed on the back side of the sloping separation plate 8 in such a manner as to correspond individually to the plurality of separation modules so provided, and supporting members 45 are disposed in such a manner as to correspond individually to the mounting cases 46 so formed.

Next, the configuration of a separation module 11 of the first exemplary embodiment will be described in detail. As shown in FIGS. 5 to 7, the separation module 11 is made of a metal sheet such as a stainless steel sheet as an elastic element. The separation module 11 includes angular (inverted V-shaped) arm portions 40 that extend from a flat main body portion (a base portion) 39, claw-shaped separation claws 36 that erect (are cut to erect) from central portions of the arm portions 40 in such a manner as to be brought into contact with a sheet P at free ends thereof, and outwardly extending elasticity imparting portions (leaf spring portions) 41 which extend from the main body portion 39.

In the first exemplary embodiment, the width dimension of the main body portion (base portion) 39 at a lower portion thereof is large. The arm portions 40 and the separation claws 36 are formed in two parallel left and right rows and in such a manner as to be arranged in a vertical direction at predetermined intervals on the lower portion of the main body portion (base portion) 39. And the elasticity imparting portions 41 are made to project obliquely upwards from left and right side edges of the lower portion of the main body portion 39. The width dimension of the main body portion 39 is small at an upper portion thereof, and the arm portions 40 and the separation claws 36 are formed in a single row in a widthwise central portion of the upper portion of the main body portion 39 in such a manner as to be arranged at the predetermined intervals along the feeding direction. The elasticity imparting portions 41 are also formed on left and right side edges of the upper portion of the main body portion 39 in such a manner as to project obliquely upwards therefrom in the similar fashion.

Each separation claw 36 has a proximal portion 36*a* that erects at right angles from the arm portion 40 and a distal end projecting portion (also referred to as a free end side) 36 that is bent in such a manner as to fall to be inclined (inclined obliquely upwards relative to the surface of the sloping separation plate 8) towards the downstream side of the feeding direction of the sheet P. According to this configuration, the separation module can simply be formed through steps of stamping the separation claws 36 and the arm portions 40 from a metal sheet and bending the separation claws 36 thereafter.

A bent portion between the proximal portion 36*a* and the distal end projecting portion 36*b* is set to reside within the thickness of the sloping separation plate 8. According to this configuration, a leading edge of a sheet P is prevented from colliding against the proximal portion 36*a* and the bent portion (in case the leading edge of the sheet P collides against this portion, the feed resisting force becomes so large that no sheet feeding can be implemented) and is then allowed to be brought into sliding contact with the distal end projecting portion 36 at a skew angle. As this occurs, a plurality of sheets P are loosened by the resisting force exerted to leading edges of the sheets P, and only a topmost sheet is separated from the rest of the plurality of sheets P.

In addition, free ends of the elasticity imparting portions 41 on the left- and right-hand sides of the main body portion 39 are supported, respectively, on end faces of vertically elongated rib portions 45*a*, 45*b*, 45*c* which are formed on an inner surface of the box-shaped supporting member 45 (refer to FIGS. 5, 6A and 6B), whereby the main body portion 39 can elastically be biased in such a state that the whole (the overall length) of the main body portion 39 is in abutment with the rear surface of the sloping separation plate 8 with no gap.

When the plurality of rows of separation claws 36 are formed integrally on the single separation module 11, the number of components can be reduced compared to a case where only a single row of separation claws 36 is formed on the single separation module 11. In addition, the plurality of rows of separation claws 36 can be formed altogether (close to each other) near the widthwise center of the main body portion (base portion) 39 of the single separation module 11, so that the configuration of the separation module 11 can be made compact. When the plurality of rows of separation claws 36 is formed integrally on the single separation module 11, the quality of the separation claws 36 varies little with respect to the thickness, material (spring constant) and the like of the separation module 11. Accordingly, it is possible to reduce further the occurrence of double- or more-sheet feeding phenomenon and sheet idle feeding phenomenon.

In the rows of separation claws 36, the separation claws 36, which are disposed on the upstream side of the feeding direction, are arranged in parallel to a direction perpendicular to the feeding direction in the first exemplary embodiment (refer to FIG. 5) and the third exemplary embodiment (refer to FIG. 10). In the second exemplary embodiment (refer to FIG. 8), the separation claws 36, which are disposed on the upstream side of the feeding direction, are arranged in a zigzag fashion. As described above, the separation claws 36 in the plurality of left and right rows, which is closer to the bottom plate 31 of the cassette main body 3, are arranged in the parallel or zigzag fashion, the opportunities are increased in which the leading edges of the plurality of sheets P collide against the plurality of separation claws 36 which are disposed at different heights from the bottom plate 31. Therefore, there is provided an advantage that occurrence of double- or more-sheet feeding phenomenon is further reliably reduced.

In addition, in the second exemplary embodiment (refer to FIG. 8), the configuration thereof is totally the same as the configuration of the first exemplary embodiment except that the separation claws 36 in the two rows disposed in the lower portion of the separation module 11 (on the upstream side of the feeding direction) are arranged in the zigzag fashion, therefore, the same reference numerals are imparted to the same configurations, so as to omit the detailed description thereof.

In the third exemplary embodiment (refer to FIG. 10), the separation claws 36 in the two rows, which are disposed in the lower portion of the separation module 11 (on the upstream side of the feeding direction), are formed into a laterally symmetrical shape in the width direction of the wider portion of the main body portion 39. A single row of separation claws 36, which is disposed in the upper portion of the separation module 11 (on the downstream side of the feeding direction), is formed in a central portion in the width direction of the main body portion 39 and is disposed between the two rows of separation claws 36 which are disposed therebelow. According to this configuration, since both the upper and lower rows of separation claws 36, the main body portion 39, arm portions 40, elasticity imparting portions 41 and the like are formed into a laterally symmetrical shape. Therefore, by disposing this single separation module 11 in the transversely central portion of the sloping separation plate 8, the separating and feeding operation, which is performed on the sheets P that are disposed in such a manner that their widthwise center lines are aligned with the widthwise center line of the cassette main body 3, can be performed in a transversely well-balanced condition.

In addition, the rows of separation claws 36 are set either in such a manner as to be disposed at a space L between the left feed roller and right feed roller 6*b* (refer to FIGS. 9 and 11) or in such a manner as to be disposed in positions which confront positions where the respective feed rollers 6*b* actually contact a sheet P. According to this configurations, the feed resisting forces exerted by the separation claws 36 are concentrated at the widthwise central portion of a sheet P, thereby making it possible to effectively prevent the sheet from passing obliquely. In addition, since a buckling phenomenon is made difficult to be produced on the sheet P between the feed rollers 6*b* and the separation claws 36, there is provided an advantage that the double- or more-sheet feeding phenomenon is made difficult to occur (the occurrence of the phenomenon concerned can be reduced).

In the above configuration, when the separation module 11 are inserted into the mounting case 46 from the back side of the sloping separation plate 8, the arm portions 40 are fitted in the openings 44, respectively, and the supporting member 45 is fixed in place, all the elasticity imparting portions (elastic legs) 41 of the separation module 11 are supported by the supporting member 45. As a result, the main body portion 39 is brought into exact abutment with the back side of the sloping separation plate 8, and the separation claws 36 project by a predetermined amount to the sheet contact (front) side of the sloping separation plate 8 with no variation in their projecting amount (refer to FIGS. 6A and 6B).

The sloping separation plate 8 is locked in locking grooves of the back supporting portions 38 that is disposed on the far side plate 37 of the cassette main body 3, and the sloping separation plate 8 is disposed in such a manner that the back side of the sloping separation plate 8 is brought into abutment with sloping planes of the back supporting plates 38. As described above, when the sloping separation plate 8 is installed in the cassette main body 3, the front surface (the side, which confronts or is brought into abutment with the leading edge of the sheet P) of the sloping separation plate 8, is also formed into a convexly curved shape (a bow shape) as viewed from the top. That is, as viewed from the top, the sloping separation plate 8 projects at its longitudinal (the X-axis direction, the width direction of the sheet P) central portion and recedes (moves away from the leading edge of the sheet P) as it extends from the central portion towards left and right end portions thereof in the width direction of the sheet P. Though the bending stress and flexing deformation of the sloping separation plate 8 become largest at the longitudinal central portion thereof (the portion where the openings 44 are provided), the bridge portions 50 formed between the adjacent small openings 44 can contribute to reinforce (enhance) the bending rigidity at the longitudinal central portion of the sloping separation plate 8 compared to a configuration in which vertically elongated openings that surround a plurality of separation claws 36 is opened. Accordingly, since no bowing which drastically projects towards the front surface of the sloping separation plate 8 is produced in the longitudinal central portion thereof (the bridge portions 50 corresponding to the openings 44), the separation claws 36 can be made to project by a designed predetermined projecting amount, thereby making it possible to ensure the operation in which sheets P are loosened to be separated.

Needless to say, above described exemplary embodiments can also be applied to an image forming apparatus in which cassette main bodies 3 are disposed in multiple stages in a vertical direction.

Figure 12:
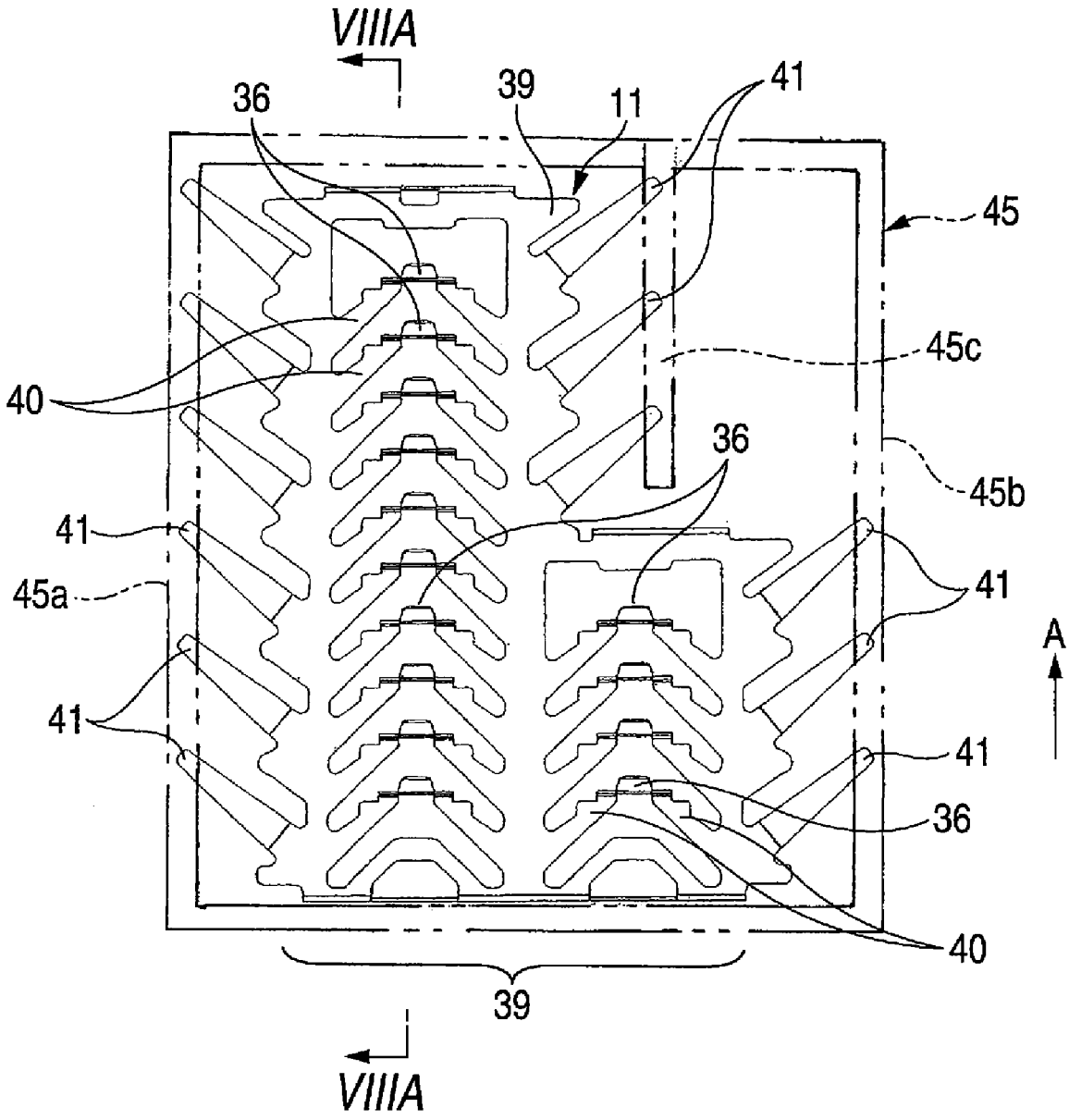
FIG. 12 is a front view of a fourth embodiment of a separation module.
Figure 13A:
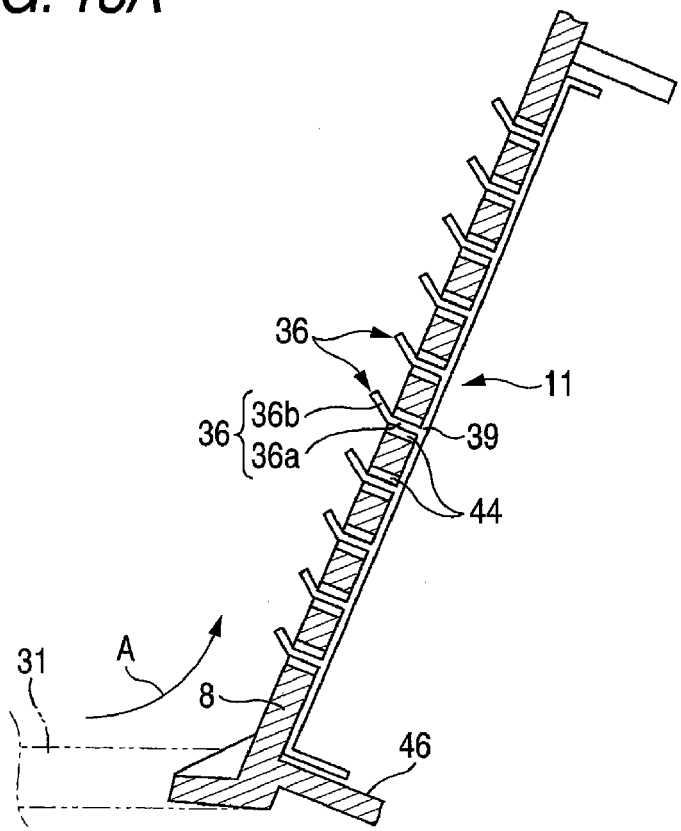
FIG. 13A is a sectional view taken along the line XIIIA-XIIIA of FIG. 12 and viewed in a direction indicated by arrows attached to the line and FIG. 13B is a partially cutaway front view of FIG. 13A.
Figure 13B:
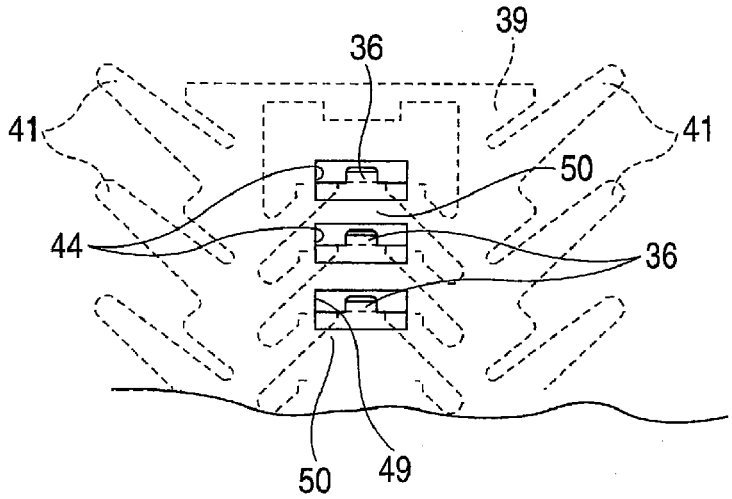

Also, in the fourth exemplary embodiment, as shown in FIG. 12, FIG. 13A and FIG. 13B, each separation claw 36 has a proximal portion 36*a* that erects at right angles from the arm portion 40 and a distal end projecting portion 36*b* that is bent from the proximal portion 36*a* in such a manner as to fall to be inclined towards the downstream side in the sheet feeding direction. In addition, as shown in FIG. 13A, an angle formed between the distal end projecting portion 36*b* that is disposed on the upstream side of the feeding direction and the sheet contact surface of the sloping separation plate 8 may be substantially equal to an angle formed between the distal end projecting portion 36*b* that is disposed on the downstream side of the feeding direction and the sheet contact surface of the sloping separation plate 8. Even when the angle disposed in the upstream side is equal to the angle disposed in the downstream side, as shown in FIG. 12, provided that a larger number of rows of separation claws 36 are disposed on the upstream side of the feeding direction than on the downstream side of the feeding direction, it is possible to reduce further the occurrence of double- or more-sheet feeding phenomenon and sheet idle feeding phenomenon.

Figure 14:
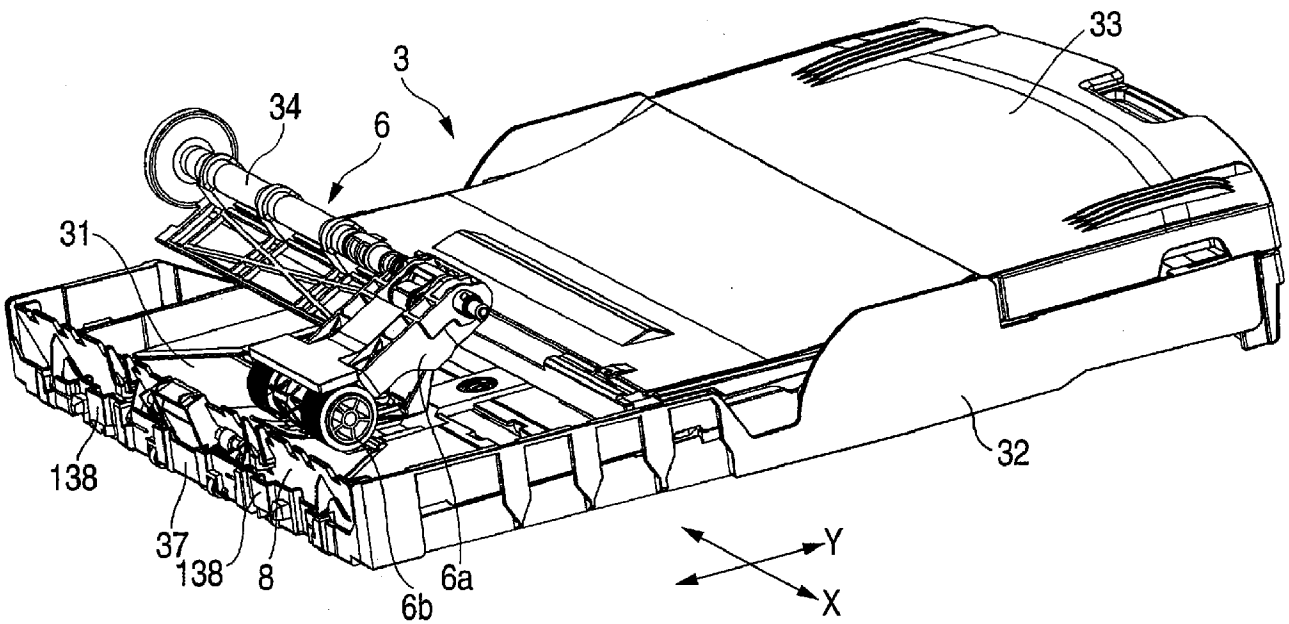
FIG. 14 is a perspective view of a cassette main body and a feed roller according to the exemplary embodiment.

And, as shown in FIG. 14, in the fourth exemplary embodiment, a plurality of back supporting portions 138, which are each formed into a trapezoidal shape (or a triangular shape) as viewed from the side, are provided on a front side of a far side plate 37 of the cassette main body 3 at predetermined intervals along the X-axis direction. The back supporting portions 138 are for supporting the back side of the sloping separation plate 8 that is made up of a single plate-shaped member as is shown in FIG. 14. A locking groove (not shown) is provided in each back supporting portion 138 in such a manner as to extend downwards from an upper end thereof. On the other hand, locking claws (not shown) are formed integrally on a rear side of the sloping separation plate 8 in such a manner as to be locked into the locking grooves in the back supporting portions 138, respectively. In addition, an enveloping surface of front sides (which correspond to a back side of the sloping separation plate 8) of the plurality of back supporting portions 138 is formed into a convexly curved shape in which it projects in a central portion thereof as viewed in the width direction of the sheet P and recedes (moves away from the leading edge of the sheet P) as it extends towards left and right end portions as viewed in the width direction of the sheet P. Consequently, by locking the locking claws into the locking grooves in the back supporting portions 138, the back side of the sloping separation plate 8 is supported by sloping surfaces on the front sides of the back supporting portions 138 and the sloping separation plate 8 is formed into a curved surface which projects in a central portion as viewed in the X-axis direction.

The present invention can provide the following illustrative, non-limiting embodiments.

According to the first aspect of the invention, the feed roller cooperates with the separation claws of which the distal projecting portions project from the sheet contact surface of the sloping separation plate provided at the downstream end of the cassette main body in the feeding direction of the sheet. The acute side angle formed between the distal projecting portion of the separation claw that is disposed on the upstream side of the feeding direction and the sheet contact surface of the sloping separation plate is set larger than the acute side angle formed between the distal projecting portion of the separation claw that is disposed on the downstream side of the feeding direction and the sheet contact surface of the sloping separation plate. Therefore, the feed resisting force, which is formed by the separation claws and the feed roller, can be increased on the upstream side of the feeding direction. That is, when a small pile of the sheets is stacked in the cassette, the feed resisting force, which is formed by the separation claws and the feed roller that is mounted at the lower end of the feed arm that is made to oscillate about the proximal end (upper end) thereof, can be increased. Because of this, the loosening operation of the leading end portions of the plurality of sheets can be ensured even in such a state that a small pile of sheets is stacked in the cassette, thereby making it possible to reduce the occurrence of double- or more-sheet feeding phenomenon.

On the other hand, the feed resisting force, which is formed by the separation claws and the feed roller, does not become too large on the downstream side of the feeding direction. That is, when a large pile of the sheets is stacked in the cassette main body, the feed resisting force, which is formed by the separation claws and the feed roller that is mounted at the lower end of the feed arm that is made to oscillate about the proximal end (upper end) thereof, does not become too large, thereby making it possible to reduce the occurrence of sheet idle feeding.

According to the second aspect of the invention, the feed resisting force, which is formed by the separation claws and the feed rollers, can be increased on the upstream side of the feeding direction by increasing the number of rows of separation claws on the upstream side of the feeding direction. That is, when a small pile of the sheets is stacked in the cassette, the feed resisting force, which is formed by the separation claws and the feed roller which is mounted at the lower end of the feed arm which is made to oscillate about the proximal end (upper end) thereof, can be increased. Because of this, the loosening operation of the leading end portions of the plurality of sheets can be ensured even in such a state that a small pile of sheets is stacked in the cassette, thereby making it possible to reduce the occurrence of double- or more-sheet feeding phenomenon. On the other hand, the feed resisting force, which is formed by the separation claws and the feed roller, does not become too large on the downstream side of the feeding direction by reducing the number of rows of separation claws on the downstream side of the feeding direction. That is, when a large pile of the sheets is stacked in the cassette, the feed resisting force, which is formed by the separation claws and the feed roller which is mounted at the lower end of the feed arm which is made to oscillate about the proximal end (upper end) thereof, does not become too large, thereby making it possible to reduce the occurrence of sheet idle feeding.

According to the third aspect of the invention, since the separation claws disposed on the upstream side of the feeding direction are arranged in the zigzag fashion relative to the direction perpendicular to the feeding direction at right angles, in addition to the function and advantage provided by the first or second aspect of the invention, an advantage can be provided that the occurrence of the double- or more-sheet feeding phenomenon can be reduced in a more ensured fashion because there are increased opportunities in which the leading edges of the plurality of sheets collide against the plurality of separation claws which are disposed at different heights from the bottom plate of the cassette.

According to the fourth aspect of the invention, the separation claws are formed on the single separation module, and such separation modules are provided detachably on the rear side of the sloping separation plate. The plurality of separation claws are formed integrally on the single separation module in that way, the positional relationship of the separation claws varies in no case, and hence, the separation claws can be set highly accurately, thereby making it possible to ensure the separating and feeding operation of sheets further.

According to the fifth aspect of the invention, since the rows of separation claws are disposed in the space between the left feed roller and right feed roller are disposed, the feed resisting force by the separation claws is concentrated at the central portion of a sheet in the width direction thereof. Therefore it is possible to prevent the sheet from becoming crooked. In addition, since the buckling phenomenon is made difficult to occur on the sheet between the feed rollers and the separation claws, there is provided an advantage that the double- or more-sheet feeding phenomenon is made difficult to occur.

According to the sixth aspect of the invention, the separation module is made of the flat metal sheet and includes the arm portions which extend from the main body portion thereof, the separation claws which are made to erect from the arm portions in such a manner as to be brought into contact with the sheet at the free ends thereof, and the elasticity imparting portions which extend from the proximal portion.

Consequently, the separation module can be formed easily by stamping the arm portions, the separation claws and elasticity imparting portions from a metal sheet and thereafter performing predetermined bending steps thereon.

According to the seventh aspect of the invention, since the accommodating portion for accommodating the separation module is formed on the rear side of the sloping separation plate and the separation module so accommodated is supported by the support module which is inserted from the back side of the accommodating portion in such a manner as not to bed is located therefrom, there is provided an advantage that the assembling work of the separation module is implemented extremely easily. In addition, there is provided an advantage that the assembling of the separation module is facilitated in such a manner that the separation claws on the separation module project in a predetermined projecting amount.

What is claimed is:

1. A sheet feeder comprising:

a cassette for accommodating sheets;

a feed roller that feeds the sheets accommodated in the cassette to an image forming unit;

a sloping separation plate that is provided on a downstream side of the cassette in a sheet feeding direction; and a separation member that is attached in the sloping separation plate, the separation member including a first separation claw and second separation claw, and the first separation claw being closer to a bottom surface of the cassette than the second separation claw, the separation member and the feed roller cooperating with each other to separate and feed the sheets, sheet by sheet;

wherein the sloping separation plate has openings so as to allow distal projecting portions of the first separation claw and second separation claw to project through the sloping separation plate, respectively, wherein, a first angle formed between the distal projecting portion of the first separation claw and the sloping separation plate is larger than a second angle formed between the distal projecting portion of the second separation claw and the sloping separation plate, and wherein, a number of rows of separation claws on an upstream side of the feeding direction is greater than a number of rows of separation claws on the downstream side of the feeding direction.

2. A sheet feeder comprising:

a cassette in which sheets can be accommodated, the cassette which is opened in an upper surface thereof to accommodate sheets;

a feed roller that feeds a topmost of the sheets accommodated in the cassette;

a sloping separation plate that is provided on a downstream end of the cassette in a sheet feeding direction, the sloping separation plate extending in a direction perpendicular to the sheet feeding direction, the sloping separation plate including a higher portion than a maximum height of the sheets accommodated in the cassette; and a separation claw that is attached to the sloping separation plate, the plurality of separation claws being aligned at predetermined intervals along the sheet feeding direction, the separation claws and the feed roller cooperating with each other to separate and feed the sheets, sheet by sheet;

wherein the sloping separation plate has openings so as to allow distal projecting portions of the separation claws to project through the sloping separation plate to a side where the sheets make contact with the sloping separation plate, respectively, and wherein, the distal projecting portion of each of the separation claws is formed in such a manner as to be bent to extend towards a downstream side of the sheet feeding direction relative to a surface of the sloping separation plate, wherein, a first angle formed between the distal projecting portion of the separation claw that is disposed on an upstream side of the sheet feeding direction and the surface of the sloping separation plate is set larger than a second angle formed between the distal projecting portion of the separation claw that is disposed on a downstream side of the feeding direction and the surface of the sloping separation plate, and wherein, a number of rows of separation claws on an upstream side of the feeding direction is greater than a number of rows of separation claws on the downstream side of the feeding direction.

3. The sheet feeder according to claim 2, wherein, the separation claws in the rows disposed on the upstream side of the feeding direction are arranged in a zigzag fashion relative to a direction perpendicular to the sheet feeding direction.

4. The sheet feeder according to claims 2, wherein, the separation claws are formed on a single separation module, and wherein, the separation module is provided detachably on a rear side of the sloping separation plate.

5. The sheet feeder according to claim 4, wherein, the separation module is made of a flat metal and comprises arm portions that extend from a proximal portion thereof, the separation claws that are erect from the arm portions in such a manner as to be brought into contact with the sheet at free ends thereof, and elasticity imparting portions that extend from the proximal portion.

6. The sheet feeder according to claim 4, wherein, the sloping separation plate comprises:an accommodating portion for accommodating the separation member, the accommodating portion being formed on the rear side of the sloping separation plate; and a support member that is inserted from a back side of the accommodating portion, the support member supporting the separation module in such a manner as not to be dislocated from the sloping separation plate.

7. The sheet feeder according to claims 2, wherein, the feed roller includes a pair of left feed roller and right feed roller, and wherein, the rows of separation claws are disposed in a space between the left feed roller and the right feed roller.

8. A sheet feeder comprising:

a cassette in which sheets can be accommodated, the cassette which is opened in an upper surface thereof to accommodate sheets;

a feed roller that feeds a topmost of the sheets accommodated in the cassette;

a sloping separation plate that is provided on a downstream end of the cassette in a sheet feeding direction, the sloping separation plate extending in a direction perpendicular to the sheet feeding direction, the sloping separation plate including a higher portion than a maximum height of the sheets accommodated in the cassette; and a separation claw that is attached to the sloping separation plate, the plurality of separation claws being aligned at predetermined intervals along the sheet feeding direction, the separation claws and the feed roller cooperating with each other to separate and feed the sheets, sheet by sheet;

wherein the sloping separation plate has openings so as to allow distal projecting portions of the separation claws to project through the sloping separation plate to a side where the sheets make contact with the sloping separation plate, respectively, and wherein, the distal projecting portion of each of the separation claws is formed in such a manner as to be bent to extend towards a downstream side of the sheet feeding direction relative to a surface of the sloping separation plate, and wherein, a number of rows of separation claws on an upstream side of the feeding direction is greater than a number of rows of separation claws on the downstream side of the feeding direction.

9. The sheet feeder according to claim 8, wherein, the separation claws in the rows disposed on the upstream side of the feeding direction are arranged in a zigzag fashion relative to a direction perpendicular to the sheet feeding direction.

10. The sheet feeder according to claims 8, wherein, the separation claws are formed on a single separation module, and wherein, the separation module is provided detachably on a rear side of the sloping separation plate.

11. The sheet feeder according to claim 10, wherein, the separation module is made of a flat metal and comprises arm portions that extend from a proximal portion thereof, the separation claws that are erect from the arm portions in such a manner as to be brought into contact with the sheet at free ends thereof, and elasticity imparting portions that extend from the proximal portion.

12. The sheet feeder according to claim 10, wherein, the sloping separation plate comprises:an accommodating portion for accommodating the separation member, the accommodating portion being formed on the rear side of the sloping separation plate; and a support member that is inserted from a back side of the accommodating portion, the support member supporting the separation module in such a manner as not to be dislocated from the sloping separation plate.

13. The sheet feeder according to claims 8, wherein, the feed roller includes a pair of left feed roller and right feed roller, and wherein, the rows of separation claws are disposed in a space between the left feed roller and the right feed roller.

* * * * *